324-77 SR
2/13/79 XR 4,139,897

United States Patent [19]
Gardner et al.

[11] 4,139,897
[45] Feb. 13, 1979

[54] FAST TWO DIMENSIONAL FOURIER TRANSFORM DEVICE

[75] Inventors: Keith L. Gardner; Henry N. Adaniya, both of Ridgecrest, Calif.

[73] Assignee: The United States of America as represented by the Secretary of the Navy, Washington, D.C.

[21] Appl. No.: 778,910

[22] Filed: Mar. 18, 1977

[51] Int. Cl.[2] ..... G06G 7/19
[52] U.S. Cl. ..... 364/827; 324/77 K; 364/822
[58] Field of Search ..... 235/151, 193; 324/77 K; 350/162 SF; 364/819, 820, 822, 827

[56] References Cited

U.S. PATENT DOCUMENTS

| | | | |
|---|---|---|---|
| 3,439,155 | 4/1969 | Alexander | 235/181 |
| 3,483,421 | 12/1969 | Hogan | 235/181 |
| 3,486,016 | 12/1969 | Faiss | 235/181 |
| 3,688,101 | 8/1972 | Henning | 235/181 |
| 3,714,566 | 1/1973 | Kang | 324/77 E |
| 3,738,731 | 6/1973 | Chandra et al. | 235/181 |
| 3,842,251 | 10/1974 | Powers et al. | 235/181 |
| 3,883,803 | 5/1975 | Donald et al. | 324/77 K |
| 3,937,942 | 2/1976 | Bromley et al. | 235/181 |
| 4,039,815 | 8/1977 | Geluk | 235/181 |
| 4,073,010 | 2/1978 | Casasent et al. | 364/822 |

OTHER PUBLICATIONS

Klass: Guidance Device Set for Pershing Tests Aviation Week and Space Technology, May 12, 1975, pp. 45–47, 48.

*Primary Examiner*—Felix D. Gruber
*Attorney, Agent, or Firm*—R. S. Sciascia; W. T. Skeer; K. G. Pritchard

[57] ABSTRACT

Two dimensional optical or electrical images are processed through a storage tube designed to yield the correlation function between the input images and stored images. By generating a series of stored images representing sine and cosine components of the Fourier transform, a fast, two-dimensional transform of the image is obtained.

9 Claims, 5 Drawing Figures

FIG. 3A
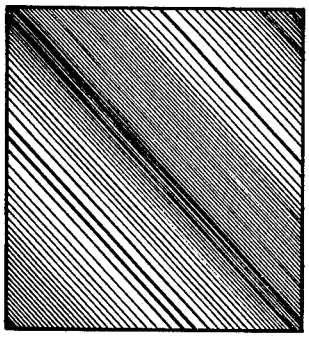
FIG. 3B
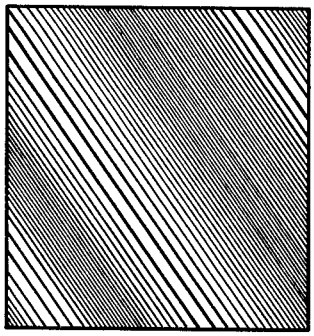
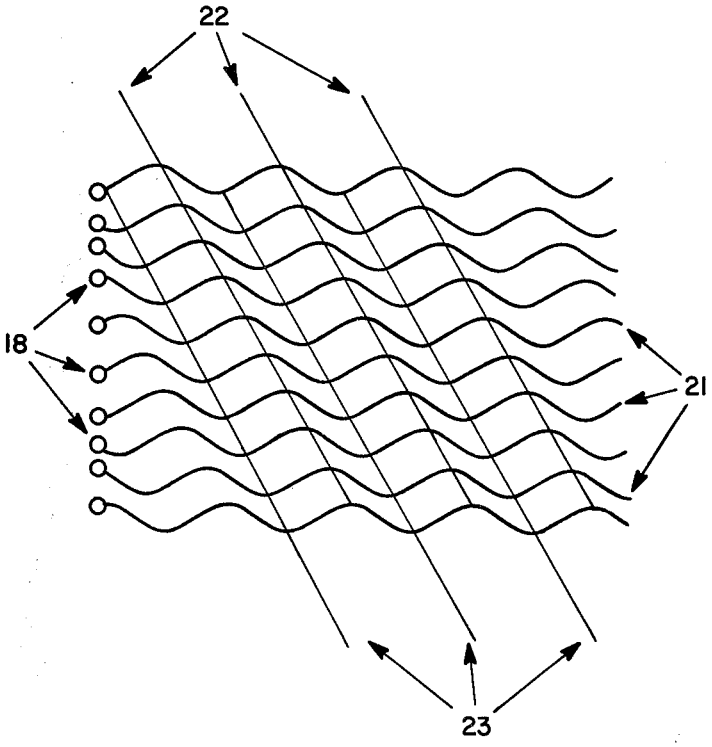
FIG. 4

FAST TWO DIMENSIONAL FOURIER TRANSFORM DEVICE

BACKGROUND OF THE INVENTION

The present invention relates to apparatus and methods for electronically performing a Fourier analysis of a two dimensional image. Its capabilities are useful in the fields of processing radar or optical images for bandwidth reduction, digital pattern recognition, image enhancement, etc.

The present device operates in two dimensions in that there are two waves present in the input signal, and two Fourier transformations are performed.

The Fourier integral can be used to calculate the frequency spectrum of an amplitude-time wave form. The Fourier integral for a voltage signal v(t) may be expressed as $$F(W) = \int_{-\infty}^{\infty} v(t)\,[\cos wt - j\sin wt]\,dt \tag{1}$$

where $j=\sqrt{-1}$ and w is frequency in radians per sec. F(w) is also known as the frequency spectrum of the signal v(t), which is represented as the amplitude of each frequency component plotted vs. frequency. It may be thought of as the breaking down of a complex wave form into sine waves present in different amounts of various discrete frequencies. The input wave is said to be plotted in the time domain while the analyzed wave is plotted in the frequency domain. A two dimensional Fourier transform is expressed as a double integral, one integral being performed in each dimension.

A typical prior art device applies an input wave form to an analog multiplier. A sine wave whose frequency can be varied linearly is then multiplied with the input to be analyzed. The multiplier output is filtered so that a dc voltage is obtained whenever the sine wave frequency reaches the fundamental or a harmonic of the wave form to be analyzed.

For two dimensional data, a software algorithm must be employed with the above technique.

A coherent optical method has also been developed for use with two dimensional data. An input signal is used to modulate a light beam in accordance with its amplitude to create a photographic record. The film is then illuminated by a laser and the image focused through a "transform lens" well known in the optical arts. Basically, the device uses optical and mechanical means to convert a signal from the time domain to the frequency domain.

Both of these approaches have drawbacks. The digital approach is either very slow if carried out by conventional minicomputers, or very expensive, if carried out by hardwire processors. Additionally, with the Fast Fourier Transform (FFT) computer algorithm there is no means for obtaining anything less than the complete Fourier transform. If only a few of the Fourier components are required for a given application, the complete calculation of the whole Fourier transform must be carried out anyway. The optical approach requires a transparent replica of the image to be transformed. To date, this requirement has excluded the optical processors from real-time, or even near real-time applications. Also, although it is relatively simple to obtain the power spectrum of an image with optical means, the true Fourier transform (i.e. including negative components) is more difficult to produce as the optics required must be very stable.

The present invention makes use of the fact that the correlation function is mathematically related to the Fourier transform, eq. (1):

$$CC_{ab}(\pm\tau) = \lim_{x\to\infty} \frac{1}{2} + \int_{-t}^{+t} a(t)b(t\pm\tau)\,dt \tag{2}$$

where $cc_{ab}$ is the correlation function of the two signals a(t) and b(t) and $\tau$ is their relative displacement.

When a(t) and b(t) are different signals, the operation is termed "cross correlation." The function is at a maximum when the two signals are identical. Numerous correlation devices exist for the comparison of an input signal with one or more stored signals.

A correlation device generates a pattern that is a time averaged or integrated product of two complete signals as their relative displacement is shifted. Minicomputers are used to perform this function, but hardware devices are available which employ sophisticated digitizing circuits and circulating memories to store the reference signal. When sampling techniques are employed, equations (1) and (2) are written as sums of terms.

Two dimensional correlators have recently been developed. Bromley et al. in U.S. Pat. No. 3,937,942 describe a device wherein a light source is modulated by an input signal and illuminates a mask whose opacity varies according to several reference signals disposed in bands on the mask. A multi-element, multi-channel charge coupled device then receives light transmitted through the mask so that each reference portion of the mask falls on a different channel. The charge picked up by each element is proportional to the correlation between the light source signal and the corresponding mask portion. The signal clocked out from each channel is a correlation function for a particular reference signal. The device of Bromley et al. of course can not be considered truly two-dimensional because there is only one input signal but devices with two light sources can readily be envisioned.

Powers et al. in U.S. Pat. No. 3,842,251 describe a correlator in which the input is two dimensional information in the form of a phased or "chirped" radar return signal, this signal being characterized as in the nature of a hologram. The input modulates the write beam of a storage tube. A storage tube is an electron tube into which information can be introduced by a writing beam onto a storage grid, from which the information is later extracted by a reading beam. (See Storage Tubes and Their Basic Principles by M. Knoll and B. Kazan, John Wiley & Sons, 1952). The read beam of the tube is modulated with a reference holographic image in the form of an electron mask. When scanning the stored image under these conditions, at any given point on the grid, output is obtained only when the stored and input images overlap.

SUMMARY OF THE INVENTION

A two dimensional correlation device is made to correlate with a series of signals representing sine and/or cosine functions of spatial frequencies associated with Fourier components. The output may be integrated to obtain the Fourier integral.

The two dimensional input signal may be optical or electronic. In the latter case when a Correlatron or similar device is to be used, the input is used to drive either a single light emitting diode (LED) or an array of LED's. An array of LED's can be arranged in one line or in two perpendicular lines and phase shifts introduced to generate the sine and cosine signals for correlation with the input.

BRIEF DESCRIPTION OF THE DRAWINGS

FIGS. 3*a* and 3*b* represent mask signals.

FIG. 4 shows how a mask signal is generated.

DESCRIPTION OF THE PREFERRED EMBODIMENT

The preferred embodiment of the present invention employs a CORRELATRON (hereinafter "Correlatron"), T.M., developed by the Goodyear Aerospace Corp. It should be understood, however, that the present invention can be practiced with any device or plurality of devices capable of performing a rapid series of correlations. The term correlatron tube is used to describe such a device, especially a modified storage tube.

Figure 1:
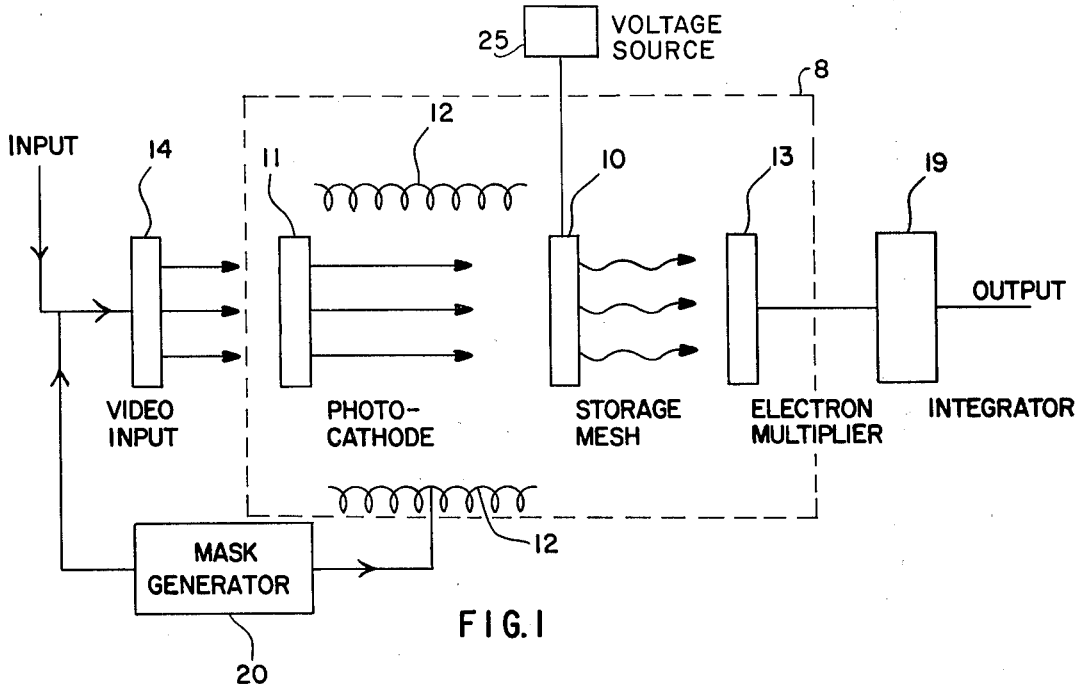
FIG. 1 is a diagrammatic representation of the fast Fourier transform device of the present invention.

Referring now to FIG. 1, the Correlatron operates by storing an image on a storage mesh 10 within a vacuum tube 8. The image is produced by focusing an optical image onto a photocathode 11 on the front surface of the tube. Electrons are thus emitted in proportion to the intensity of incident light thereby forming an electron image replica of the optical image. This electron image then propagates through an electronic deflection system 12 where it can be spatially scanned, magnified, or demagnified using conventional vacuum tube techniques. The beam next falls on the dielectrically coated storage mesh 10. The mesh 10 can be biased in any of three modes: (1) write, (2) erase, and (3) read.

In mode (1), the electron beam impinges on the mesh while the mesh is at a positive potential. A charge distribution which is a replica of the original optical image is thus produced on the storage mesh. This stored image is very stable, and can be stored for many hours or days with no degradation. The image can be erased very quickly by properly adjusting the bias level from voltage source 25 and flooding the mesh with electrons (mode (2)). The third mode of operation involves storing one image on the storage mesh, and passing a second electron image through it. Here the bias level from voltage source 25 is adjusted so that neither the writing or erasing functions occur, but the electron current is modified by the spatial charge distribution on the mesh. The greatest signal is obtained through the electron multiplier 13 when the stored and scanned images are identical, and overlay each other exactly. It can be shown that the output of the device through the electron multiplier 13 is in fact the correlation function of the two images.

The Correlatron is capable of performing correlation operations upon optical and/or electronic images. Electronic input is shown in FIG. 1 feeding video input 14. This could be a TV system or a similar arrangement. Video input 14 also receives input from mask generator 20. The video input 14 may be replaced by a lens for focusing a real world image onto the photocathode 11. It may also contain a single light emitting diode (LED) which produces a single electron beam which is scanned onto the storage screen 10 through a raster scan on the electronic deflection system 12.

The present invention correlates images with electronic signals called "masks." Each different mask signal represents a different term in a Fourier series. Either the image to be evaluated or the Fourier mask signal is converted to an electronic signal which is stored on storage screen 10 as a spatial distribution of electrical intensity. Storage screen 10 holds one electrical image while the other, either the image in question or the mask signal, is passed through storage screen 10. The two images are correlated by this process. The output of the correlation device represents a term in a Fourier series. When necessary or appropriate, the terms can be integrated with a standard integrating circuit 19.

"Masks" can be developed using the function:

$$A=\cos(F_x x+F_y y)$$

where $F_x$ and $F_y$ are the spatial frequencies associated with the Fourier component in the x and y directions respectively, and x and y are the position coordinates. "A" represents the amplitude of the function. The various required masks are generated by varying the values of $F_x$ and $F_y$, each of which may take on any value from zero up to N/2. The integer N represents the number of resolution elements per axis in the image being transformed, if the full resolution is to be conserved in the transform. N may also be an arbitrary number selected on system requirements. For smaller values of N, less image information will be contained in the Fourier transform. The cosine function in (1) represents the real part of the Fourier transform. A similar set of sine functions would be used to generate the imaginary part. The sine masks would resemble the cosine masks, except that the intensity maxima would be shifted in phase. The total number of masks required for production of a complete Fourier transform would thus be $N^2/2$.

The number of separate functions needed for sine and cosine is each equal to the sum of the number $F_x^2 + F_y^2$. If both $F_x$ and $F_y$ equal N/2, the number of masks for the sine functions in each direction is $N^2/4$ and the complete Fourier transform uses $N^2/2$ masks. Similar reasoning requires $N^2/2$ masks for a two dimensional Fourier cosine function.

Using the above function, masks can be visualized as follows:

(1,0), one central vertical bar;
(2,0). two vertical bars;
(0,1), one central horizontal bar;
(0,2), two horizontal bars;
(1,1), two diagonal bars;
(2,1), 3 diagonal bars;
(1,2), 3 diagonal bars approximately 90° to those of (2,1). Samples of such masks are shown in FIG. 3. The line density variations represent intensity variations.

It should be understood that, by means of the present invention, other mathematical transformations than the Fourier transformation may be performed. For example, a Walsh transform may be performed by using checkered masks, as would be apparent to one skilled in the art.

Figure 2:
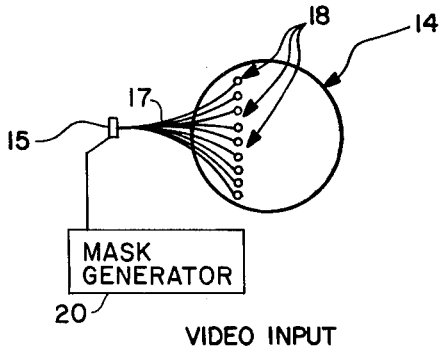
FIG. 2 is a preferred embodiment of a video input of the device.

FIG. 2 shows one possible arrangement for producing the required Fourier transform masks. Mask signal generator 20 is coupled to a linear array of LED's 18 via a coupler 15 and wires 17. LED's 18 are on the surface of video input 14 as shown. The number of LED's should be enough to conserve the cosine function. Mask signal generator 20 consists of standard electronics for generating a sine wave to drive each of the LED's with a sinusoidal variation in brightness. LED's 18 produce a linear electron beam response from photocathode 11. LED's 18 are arranged so that the electron beam produced is scanned in a direction orthogonal to the linear array by electronic deflection system 12. An equal phase shift is introduced between successive LED's 18, such that when the electron beam is scanned, a series of light and dark bars are produced on storage mesh 10.

FIG. 4 is an example of a pattern generated by the array shown in FIG. 2. The linear array of LED's 18 generates sine waves 21. Successive LED's show an equal phase shift as previously mentioned. Lines 22 represent bright lines and lines 23 represent dark lines. They do not correspond to the lines shown in FIG. 3. The lines in FIG. 3 represent shading only.

Other mask producing arrangements may be employed. One LED can be used with a raster scan, or two orthogonal linear LED arrays can be used with two dimensional scanning. This may be used with two storage meshes.

When employing two storage meshes, the image to be transformed is first stored on the second mesh. This can be accomplished by biasing the first mesh in the erase mode and using both LED arrays. Then one linear LED light driving array is modulated at an appropriate sinusoidal frequency while an electronic image of array 1 is scanned along mesh 1 and stored to form a mask varying sinusoidally in one dimension. The second LED array then similarly scans a sinusoidally modulated mask in the orthogonal direction while meshes 1 and 2 are in the read mode. The integrated signal output will be proportional to the dimensional Fourier sine component corresponding to the effective spatial frequencies produced by scanning and modulating array 1 and 2. By varying the mask patterns as described above, the complete Fourier transform of the image can be produced.

The method and apparatus described herein are capable of producing near real-time transforms of either optical or electronic data. The device is inherently fast, and should compare very favorably with digital processors, and at a much lower cost. The device operates in an analog mode, with no requirement for sampling, digitizing, or recording the data outside the Correlatron.

The Fourier processor is very flexible. It is possible to evaluate individual Fourier components, simply by correlating the image with the desired masks. This is not possible with the digital FFT. In addition, the correlation approach is not limited to Fourier transformation. Other transforms, such as the Walsh Transform, may be obtained by changing the mask generating mechanism.

What is claimed is:

1. A device for deriving an electrical signal representative of a two dimensional Fourier transform of a two dimensional input image comprising:

means for generating video two dimensional input images;

a correlation device placed to receive said video two dimensional input images such that said video images are converted to electrical signals representing said input images;

a storage screen within said correlation device placed in the path of said converted electrical signals for storing a predetermined electrical signal;

a voltage source electrically connected to said storage screen for controlling when said electrical signals are stored, erased or passed through said storage screen such that a predetermined input image's electrical signal is stored on said storage screen while electrical signals representing other input images are passed through said storage screen for correlation with said stored image;

means for generating a series of signals representative of mask images of terms in a Fourier series into said correlation device where they are correlated with said stored input image and then emitted as correlated output; and means for integrating said correlated outputted mask signals so as to determine the Fourier transform of said stored input image.

2. The device of claim 1 wherein said mask signal generating means includes a linear array of light emitting diodes responsive to a phase varied sinusoidal input signal.

3. The device of claim 1 wherein said correlation device comprises;

a photocathode for converting said video input image into an electron beam image;

a storage mesh for storing said electron beam image from said photocathode;

a voltage source connected to said storage mesh such that said storage mesh can be operated in one of three modes, read, write or erase;

electronic deflection means between said photocathode and said storage mesh for scanning said electron beam image from said photocathode across said storage mesh; and an electron multiplier for enhancing signals from said photocathode that have been transmitted through said storage mesh.

4. The device of claim 3 wherein the aforesaid mask signal generating means includes a linear array of light emitting diodes responsive to a phase varied input signal whereby said photocathode produces a linear electron beam response.

5. The device of claim 1 further comprising an integrating circuit for providing integrals of said terms in a Fourier series.

6. A method for deriving an electrical signal representative of a two dimensional Fourier transformation of a two dimensional input image comprising the steps of:

(a) feeding the input into a correlation tube with a storage screen having an adjustable voltage bias which is set to cause storage of said input image signal on said storage screen;

(b) generating a number of two dimensional mask signals representing two dimensional cosine functions of Fourier frequency components, so that each mask signal represents a term in a Fourier cosine series, and approximately equal in number to $N^2/2$ where N represents the number of resolution elements per axis in the image being transformed; and (c) sequentially inputting said mask signals into said correlation tube so as to correlate each mask signal with the stored input image signal in the correlation tube.

7. The method of claim 6 where said two dimensional mask signal represent two dimensional sine functions of Fourier frequency components.

8. The method of claim 7 further comprising the step of integrating the sequential correlations whereby the individual correlated terms of the Fourier series are integrated into the complete Fourier transform.

9. The method of claim 6 further comprising the step of integrating the sequential correlations whereby the individual correlated terms of the Fourier series are integrated into the complete Fourier transform.

* * * * *